US005447380A

United States Patent [19]

Colonel et al.

[11] Patent Number: 5,447,380

[45] Date of Patent: Sep. 5, 1995

[54] THERMAL PRINTER

[75] Inventors: Kenneth Colonel, Ronkonkoma; Edward H. Lau, Old Westbury; Dalton C. Marris, Selden, all of N.Y.

[73] Assignee: NAI Technologies, Inc., Woodbury, N.Y.

[21] Appl. No.: 190,230

[22] Filed: Jan. 31, 1994

Related U.S. Application Data

[63] Continuation of Ser. No. 891,787, Jun. 1, 1992, abandoned.

[51] Int. Cl.[6] ..... B41J 2/32; B41J 29/02

[52] U.S. Cl. ..... 400/120.01; 400/693; 346/76 PH; 346/145; 347/222

[58] Field of Search ..... 400/88, 120, 207 E, 400/642, 692, 693, 694, 54, 74, 124, 120.01; 346/76 PH, 136, 145; 165/80.3

[56] References Cited

U.S. PATENT DOCUMENTS

| | | | |
|---|---|---|---|
| 4,300,142 | 11/1981 | Kos | 346/76 PH |
| 4,563,690 | 1/1986 | Tomita | 346/76 PH |
| 4,639,739 | 1/1987 | Tsutsumi | 346/76 PH |
| 4,641,980 | 2/1987 | Matsumoto et al. | 400/120 |
| 4,660,053 | 4/1987 | Tsutsumi et al. | 346/76 PH |
| 4,706,095 | 11/1987 | Ono et al. | 346/76 PH |
| 4,746,932 | 5/1988 | Sato | 346/76 PH |
| 4,836,697 | 6/1989 | Plotnick et al. | 400/120 |
| 4,848,941 | 7/1989 | Imaseki et al. | 400/120 |
| 4,869,606 | 9/1989 | Lehmann et al. | 400/208 |
| 4,896,166 | 1/1990 | Barker et al. | 346/76 PH |
| 4,910,602 | 3/1990 | Sakuragi | 400/207 X |
| 4,938,616 | 7/1990 | Shiozaki et al. | 400/120 |
| 4,943,814 | 7/1990 | Otto | 346/1.1 |
| 4,962,430 | 10/1990 | Hiroki et al. | 346/145 X |
| 4,990,930 | 2/1991 | Ludden et al. | 346/1.1 |
| 5,001,498 | 3/1991 | Shimizu et al. | 346/76 PH |
| 5,003,429 | 3/1991 | Baker et al. | 165/80.3 X |
| 5,011,310 | 4/1991 | Wiechert | 400/207 |
| 5,062,722 | 11/1991 | Shiozaki | 400/120 |
| 5,063,395 | 11/1991 | Nuita et al. | 346/76 PH |
| 5,070,342 | 12/1991 | Okumura et al. | 346/76 PH |
| 5,072,237 | 12/1991 | Takaoka | 346/76 PH |
| 5,128,763 | 7/1992 | Sakuragi | 346/76 PH X |
| 5,163,766 | 11/1992 | Fushimi et al. | 400/692 |

FOREIGN PATENT DOCUMENTS

| | | | |
|---|---|---|---|
| 2542827 | 9/1984 | France | 400/692 |
| 0229585 | 10/1986 | Japan | 400/207 E |
| 0014174 | 1/1990 | Japan | 346/145 |

OTHER PUBLICATIONS

Mannesmann Tally Model MT735 Brochure (1990).

*Primary Examiner*—Chris A. Bennett
*Attorney, Agent, or Firm*—Dilworth & Barrese

[57] ABSTRACT

A thermal printer is provided which can operate at high speeds either as a direct thermal printer or a thermal transfer printer. The thermal printer includes a frame, a front door assembly pivotally connected to the frame and having a thermal head secured thereto. The front door assembly positions the thermal head to facilitate recording of information on a recording medium when the door is closed as well as dissipating heat generated by the thermal print head. A platen roller is positioned within the frame which conveys the recording medium between the thermal head and the platen roller. The thermal printer also provides interference shielding which maintains security of printed data. The thermal printer is also configured to allow operation in a rigorous environment.

42 Claims, 12 Drawing Sheets

THERMAL PRINTER

This is a continuation of copending application Ser. No. 07/891,787, filed on Jun. 1, 1992, now abandoned.

BACKGROUND OF THE INVENTION

1. Field of the Invention

The present invention relates to high speed thermal printers, operable either as a direct thermal printer or a thermal transfer printer, which are configured to operate in rigorous environments, and to provide easy access to the internal structure.

2. Description of the Related Art

There are two basic types of thermal printers, one being direct thermal printers and the other being thermal transfer printers. In thermal transfer printers heat from a thermal head is transferred to an ink ribbon which then applies the appropriate dot to standard paper. By contrast, in direct thermal printers heat from the thermal head is directly transferred to thermal sensitive paper which then forms the appropriate dot.

Thermal printers are generally equipped with a thermal head which includes a plurality of heating elements arranged in a horizontal column, a platen roller and associated drive mechanisms for feeding paper from a paper drive roller. If the thermal printer being utilized is of the thermal transfer type, an ink ribbon and its associated drive mechanisms will be included in the thermal printer. One common characteristic of known thermal printers is that the thermal head is buried within the interior of the printer, which traps heat within the printer. As a result, it is necessary to vent or dissipate the excess heat from the interior of the printer.

Conventional printers are generally configured to operate in a standard business environment. Such an environment typically requires a frame constructed to minimally support the internal components of the product in a stationary environment. Also, conventional thermal printers generally operate at speeds of 300 lines per minute or less. Operation at such speeds in the above described environment do not require extensive shielding from electrical and/or magnetic fields which exist in the environment.

Therefore, a need exists for a high speed combination direct transfer and thermal transfer printer which is constructed for rugged use, i.e., vibration and mechanical shock tolerant, and which essentially shields radiating electrical and/or magnetic interference.

SUMMARY OF THE INVENTION

The present invention relates to thermal printers which include a housing having an interior frame and a door assembly having a thermally conductive portion and a heat dissipation portion on the exterior surface thereof. A thermal head is mounted on the interior surface of the thermally conductive portion of the door assembly and facilitates recording of information on a recording medium. A platen roller is positioned within the frame which conveys the recording medium between the thermal head and the platen roller. The platen roller is rotated at a predetermined rate which coincides with high speed operation of the printer. In a particularly useful embodiment, the thermal printer provides interference shielding which helps maintain security of printed data.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
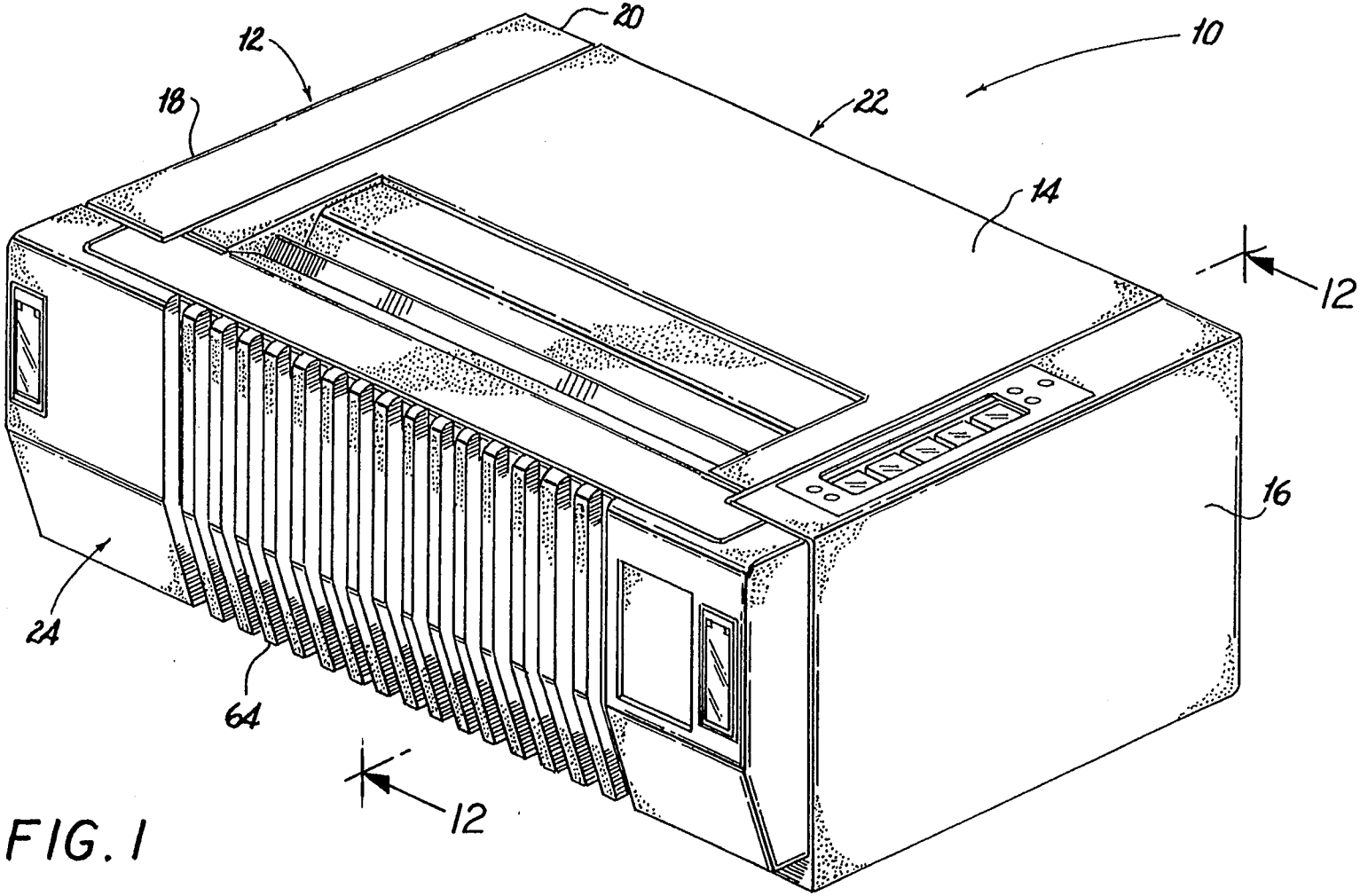
FIG. 1 is a perspective view of preferred thermal printer of the present invention.
Figure 2:
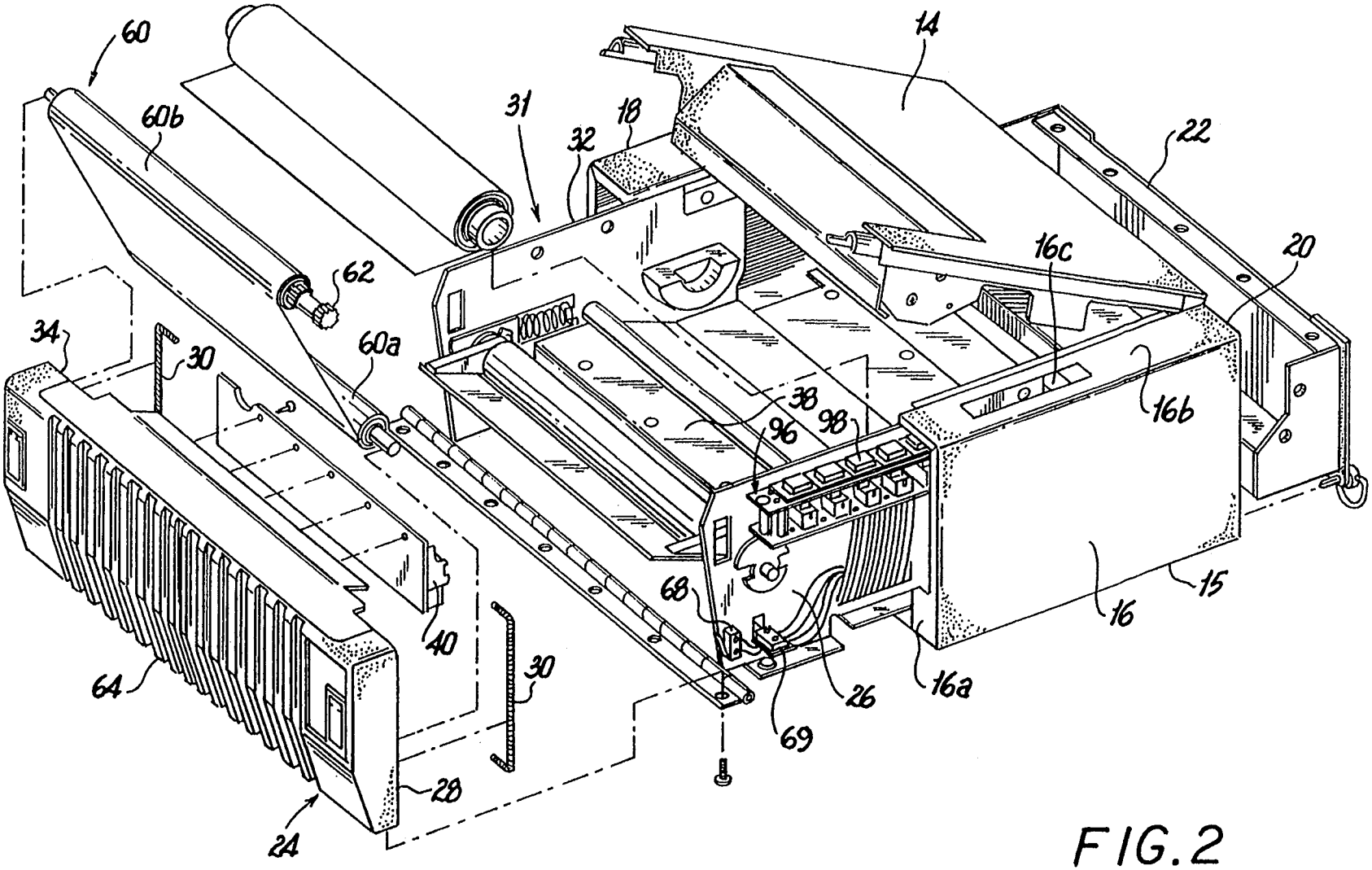
FIG. 2 is an exploded perspective view of the thermal printer of FIG. 1.

Referring to FIGS. 1 and 2, a preferred thermal printer of the present invention is shown and generally indicated by the numeral 10. In this preferred embodiment, thermal printer 10 includes housing 12 surrounding an interior frame or chassis and defining electrically isolated sections, removable rear module 22 and front door assembly 24. Housing 12 includes cover 14 which is pivotally mounted to the rear surface 20 of housing 12. Cover 14 provides easy access to the interior portion of the housing and includes an opening for the discharge of the printed recording medium. Lower surface 15, first and second side surfaces 16 and 18, respectively, and rear surface 20 are provided to further encapsulate the frame and the interior parts of the printer 10. Alternately, housing 12 may be of monolithic construction. Also included in the thermal printer of the present invention is front door assembly 24 which provides easy access to the interior of the housing and direct access to ink ribbon 60 and thermal head 40.

Figure 3:
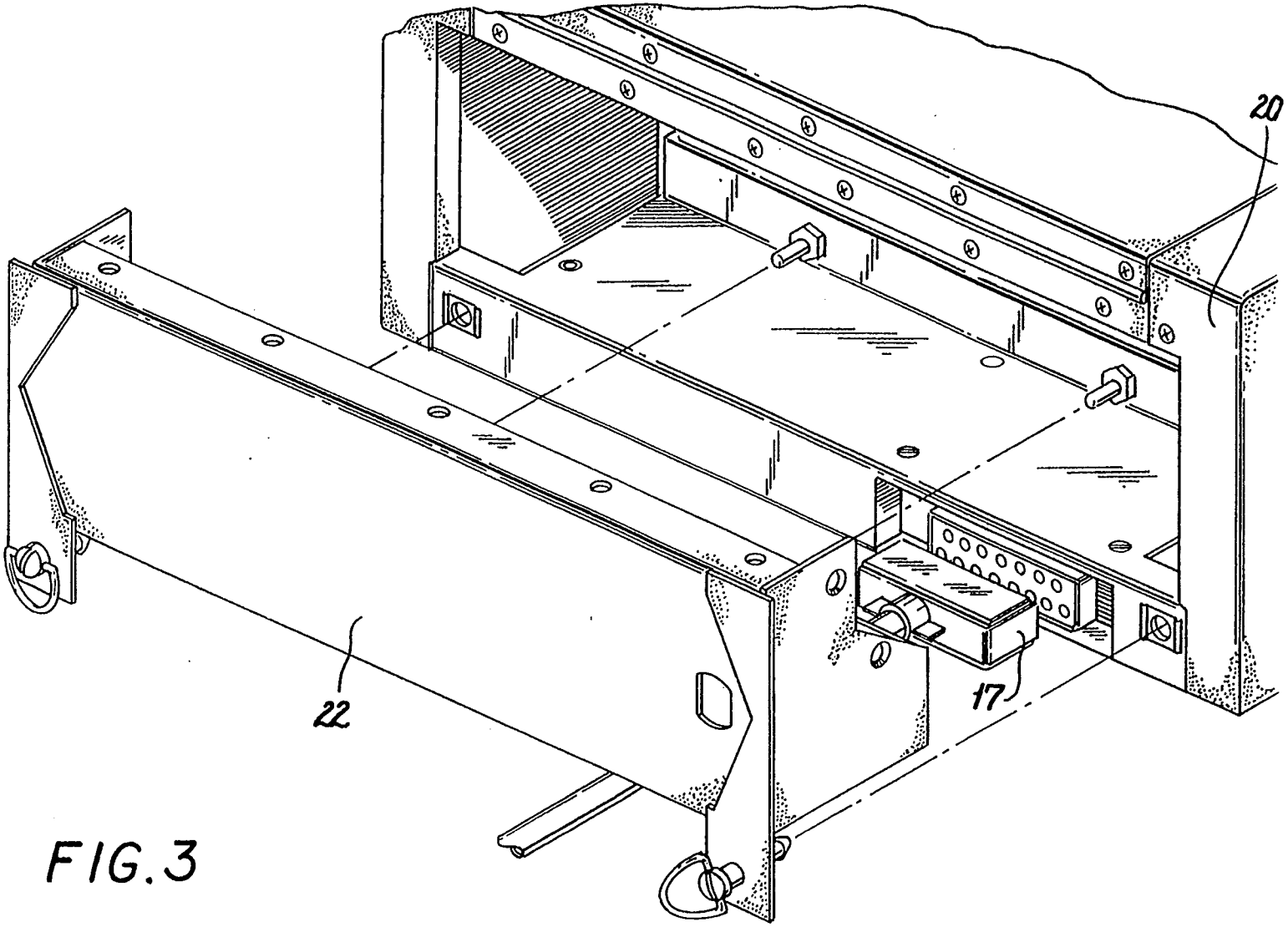
FIG. 3 is a perspective view from the rear of the thermal printer of FIG. 1, illustrating the removable power supply module.

Thermal printer 10 is configured to interface with any known type of control unit such as a computer, etc. Communication between the control unit and the thermal printer occurs through either a parallel port or serial port. The interface is provided via cable assembly 17, shown in FIG. 3, which is known in the art. Cable assembly 17 is electrically connected to a processing system positioned within thermal printer 10. Generally, the processing system provides and receives control and data signals from the control unit, stores information received from the control unit, provides information to the thermal head for printing, monitors the various switches and other internal components and responds to predetermined conditions therefrom. Processing systems of this type are known in the art and generally include a microprocessor, memory and operating firmware.

Figure 4:
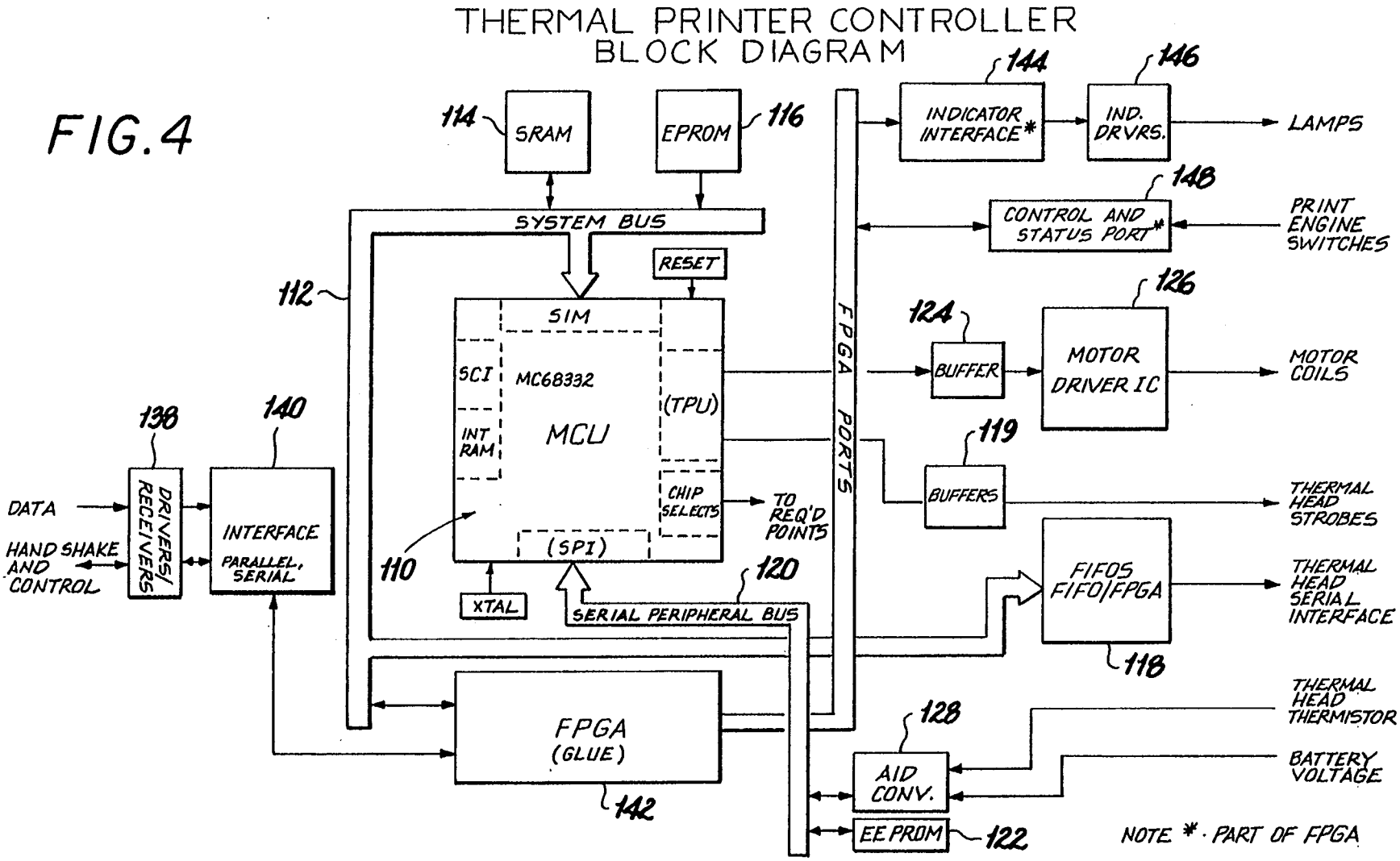
FIG. 4 is an electrical block diagram of the processing system of the present invention.
Figure 5:
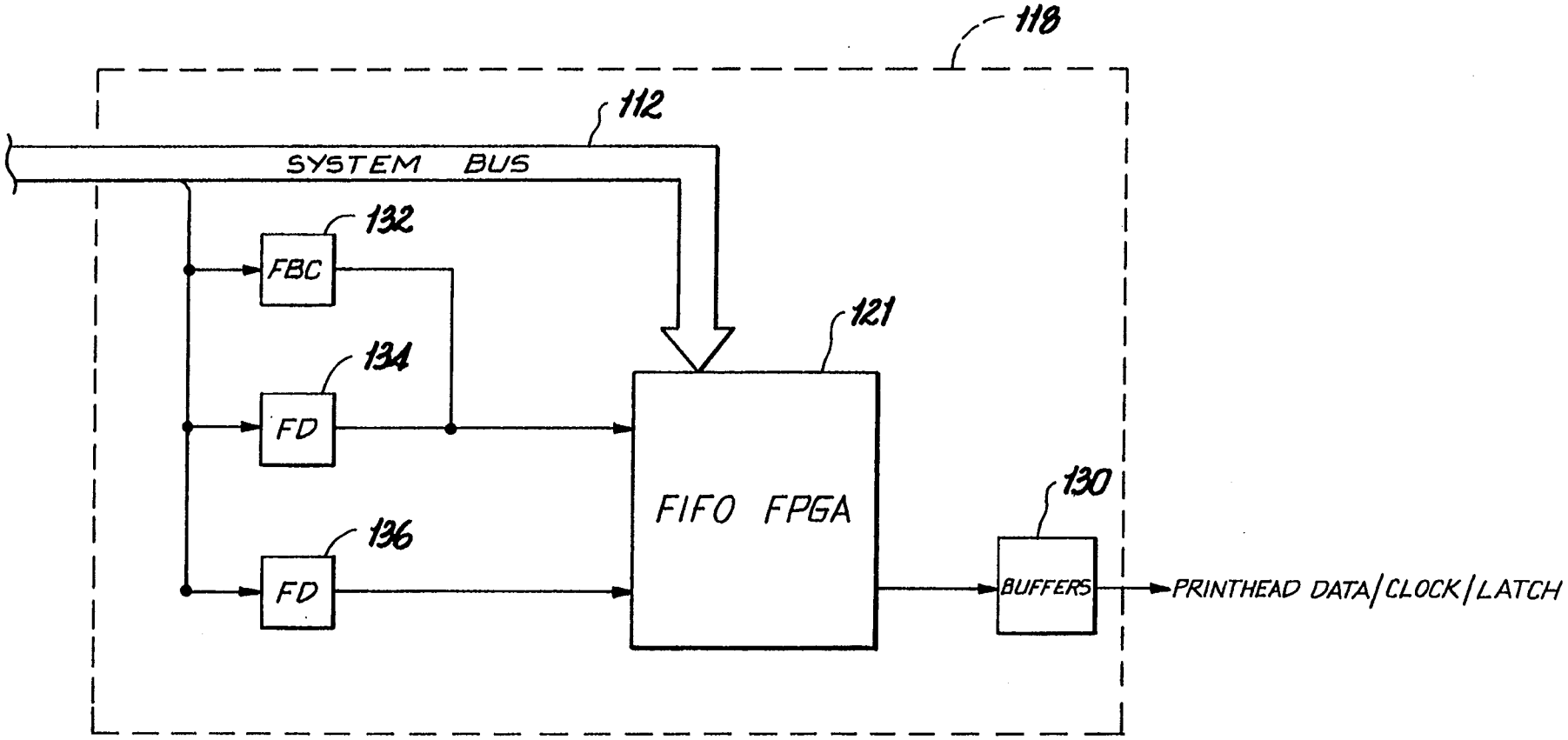
FIG. 5 is a partial electrical block diagram of a preferred first in first out field programmable gate array configuration for the processing system of FIG. 4.

An electrical block diagram for the processing system is illustrated in FIGS. 4 and 5. The overall control of the processing system is effectuated by micro computer unit (MCU) 110 in combination with the operating firmware stored in electrically programmable read only memory (EPROM) 116. A representative micro-computer for use as the MCU is model MC68332 manufactured by Motorola. Interaction between MCU 110 and the various components of the processing system occurs through system bus 112 and serial peripheral bus 120. The MCU is connected to system bus 112 which interfaces the processor system memory and first in first out/field programmable gate array (FIFO/FPGA) 118 to MCU 110, while serial peripheral bus 120 interfaces the thermal head thermistor signal and the battery voltage signal with MCU 110. Serial peripheral bus 120 also interfaces electrically erasable programmable read only memory 122 with MCU 110.

Generally, the processing system memory includes random access memory (RAM) 114 and EPROM 116 both of which are known in the art. The processing system memory allows MCU 110, as well as other components of the processing system, to read data from and write data to RAM 114 and to read data from EPROM 116.

As noted above, MCU 110 is connected to electrically erasable programmable read only memory (EEPROM) 122 by serial peripheral bus 120. EEPROM 122 allows the operator to change initial set-up data, such as the baud rate or character font, and to store the data until EEPROM 122 is reprogrammed by the operator.

Motor drive signals are provided by MCU 110 through buffer 124 and motor driver 126 which cause the motor to rotate at a predetermined rate. As will be discussed in further detail, rotation of the motor causes the platen roller and the ink ribbon to rotate at a predetermined rate.

Thermal head strobes are provided by MCU 110 through buffers 119 to cause the thermal head to print a horizontal scan line. Typically, the pulse width of the thermal head strobe is between 400 and 500 microseconds, at room temperature. Analog to digital (A/D) converter 128 is connected to MCU 110 through serial peripheral bus 120 and is an interface between MCU 110 and the thermal head thermistor. Interaction between MCU 110 and the thermal head thermistor allows MCU 110 to vary the pulse width of the thermal head strobes so that the pulse width will either increase or decrease depending upon the temperature of the thermal head. For example, as the temperature of the thermal head increases the signal from the thermal head thermistor changes, causing MCU 110 to respond by decreasing the pulse width of the thermal head strobes. If the temperature of the thermal head reaches a predetermined level, preferably 55° C., the signal from the thermal head thermistor causes MCU 110 to stop printing (i.e., stop sending thermal head strobes) until the thermal head temperature falls below a predetermined level, preferably 50° C.

Generation and distribution of character information representing the characters or fonts to be printed will now be discussed with reference to FIGS. 4 and 5. Initially, MCU 110 converts the character or font to be printed into horizontal scan line words, which is the format required for the preferred thermal head utilized in the present invention. Typically, for the default character or font of the present invention one line of print equals fifty horizontal scan lines. MCU 110 then stores the character or font information in the processor system memory in 32 bit words and determines how many bits of the 32 bit word actually represents character or font information. The bit count is then stored in the processor system memory. To illustrate, if the default character or font is utilized, each horizontal scan line word (32 bits) will only need 30 bits of the 32 bit word to print the representative character information. Therefore, the bit count will be 30 bits and the remaining 2 bits of the 32 bit word will be discarded.

In one embodiment shown in FIG. 4, FIFO/FPGA 118 receives character information from MCU 110 via system bus 112. When utilized in this configuration the character information from MCU 110 is serially transferred to the thermal head serial interface by FIFO/FPGA 118, as shown in FIG. 4. However, the operational speed of the data transmission rate is limited to the speed of FIFO/FPGA 118 since FIFO/FPGA 118 cannot receive the next horizontal scan line word until the previous word has been transmitted from FIFO/FPGA 118 through buffers 130 to the thermal head.

In the preferred embodiment shown in FIG. 5, FIFO's 132, 134 and 136 are provided to receive the horizontal scan line words and the bit count, i.e., the number of valid or active bits in the 32 bit character word. Bit count FIFO (FBC) 132 receives the number of valid bits for the 32 bit horizontal scan line word, while data FIFO's 134 and 136 receive the horizontal scan line word in two 16 bit words. In this preferred embodiment, MCU 110 also provides function select controls to FIFO FPGA 121, while providing the horizontal scan line word to FIFO's 134 and 136. As a result, this configuration allows FIFO FPGA 121 to continuously send data to the thermal head at a rate of at least about 600 print lines per minute, while data FIFO's 134 and 136 and bit count FIFO 132 receive subsequent horizontal scan line words and associated bit counts.

As noted above the processing system is configured to interface with an external control unit. Driver/-receivers 138 and parallel or serial switchable interface 140, which are known in the art, are combined with FPGA 142 to provide the interface circuitry between MCU 110 and the control unit, as shown in FIG. 4. FPGA 142 also interfaces MCU 110 with the various indicators and alarms provided with the thermal printer. For example, FPGA 142 sends signals to the indicators through indicator interface 144 and indicator drivers 146. Additionally, FPGA 142 receives signals from the various status switches of the thermal printer through control and status port 148 and transfers the information to MCU 110.

Referring again to FIG. 1, the outer surface (or front face) of front door assembly 24 is provided with heat fins 64, which dissipate heat generated by thermal head 40. Preferably, heat fins 64 are vertically positioned to provide efficient dissipation of heat by natural convection. It is also preferred that front door assembly 24 be provided with a heat conductive portion fabricated from a material which is heat conductive as well as electrically conductive, such as, for example cast aluminum.

Figure 6:
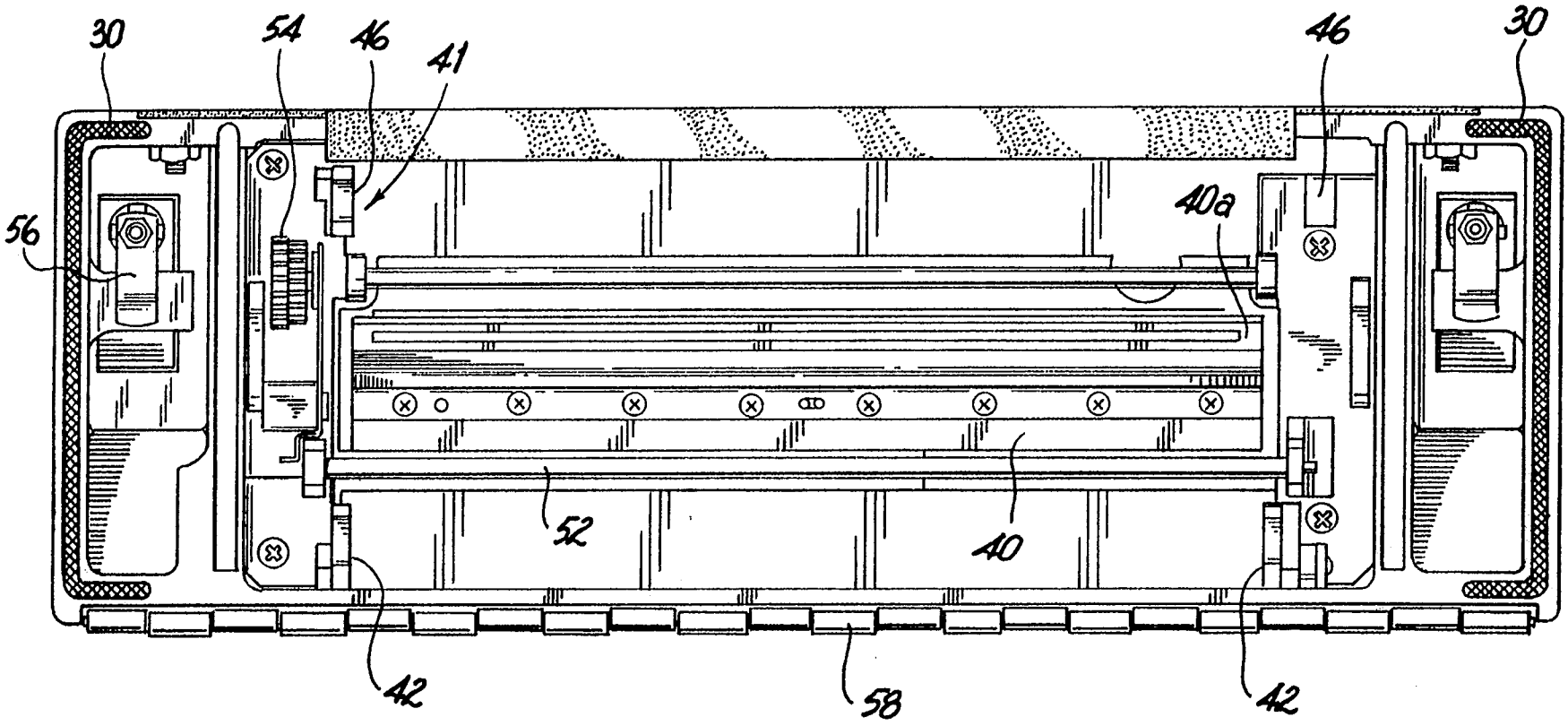
FIG. 6 is rear of the front door assembly of the thermal printer of FIG. 1.

Turning to FIG. 6, the interior of front door assembly 24 generally includes thermal head 40, ink roller support system 41, ribbon roller shafts 50 and 52, ink ribbon drive B gears 54, door latches 56, and hinge 58. Door latches 56 in combination with hinge 58 provide rigid securement of front door assembly 24 to housing 12 and chassis assembly 31. The illustration in FIG. 6 is an example of the preferred front door assembly when the printer is being utilized as a direct thermal printer, that is, with the ink ribbon removed.

Thermal head 40 is of a type known in the art which is suitable to print data at data bit rates of at least about 600 lines per minute. Thermal head 40 is electrically connected to the processing system via any cable assembly known in the art, preferably, a flat ribbon cable.

Referring to FIGS. 2 and 6, ink roller support system 41 includes supply ribbon holders 42 and takeup ribbon holders 46 which are configured to provide a continuous ink supply adjacent to thermal head 40 at a predetermined incremental rate, which is preferably equivalent to the rate paper is fed. When the thermal printer of the present invention is being utilized as a transfer thermal printer, ink ribbon 60 would be positioned on front door assembly 24 such that a portion of ink ribbon 60 is adjacent heat generating section 40*a* along its longitudinal axis.

Preferably, ink ribbon 60 includes an ink ribbon supply roller 60*a* and an ink ribbon take-up roller 60*b*. Supply roller 60*a* is releasable secured to lower ribbon holders 42, while take-up roller 60*b* is releasable secured to upper ribbon holders 46. When front door assembly 24 is in the closed position, supply roller 60*a* is further secured within lower ribbon holders 42 by compression springs 35, shown in FIG. 5. Compression springs 35 apply pressure to supply roller 60*a* sufficient to prevent supply roller 60*a* from dislodging from the lower holders 42 during printing operation and supply a fixed drag torque to supply roller 60*a*. Take-up roller 60*b* has an ink roller gear 62 positioned to engage ink roller drive B gears 54, which rotates the ink ribbon at the predetermined slip torque. With the diameter of take-up roller 60*b* variable and the gear mesh between ink ribbon drive A gear 66 and ink ribbon drive B gears 54 fixed, the slip torque is sufficient to pull the ribbon with the paper motion. However, if the paper is moving at a slower rate than the ribbon drive the slip torque is such as to allow the gear mesh to slip. In an alternate embodiment, take-up roller 60*b* may be operatively connected to gears (not shown) which engage the drive B gears and provide rotational movement of take-up roller 60*b*. Preferably, the incremental rate of rotation for ink ribbon take-up roller 60*b* is directly related to the rotational rate at which paper is conveyed past the thermal heat section 40*a* of thermal head 40.

Figure 8:
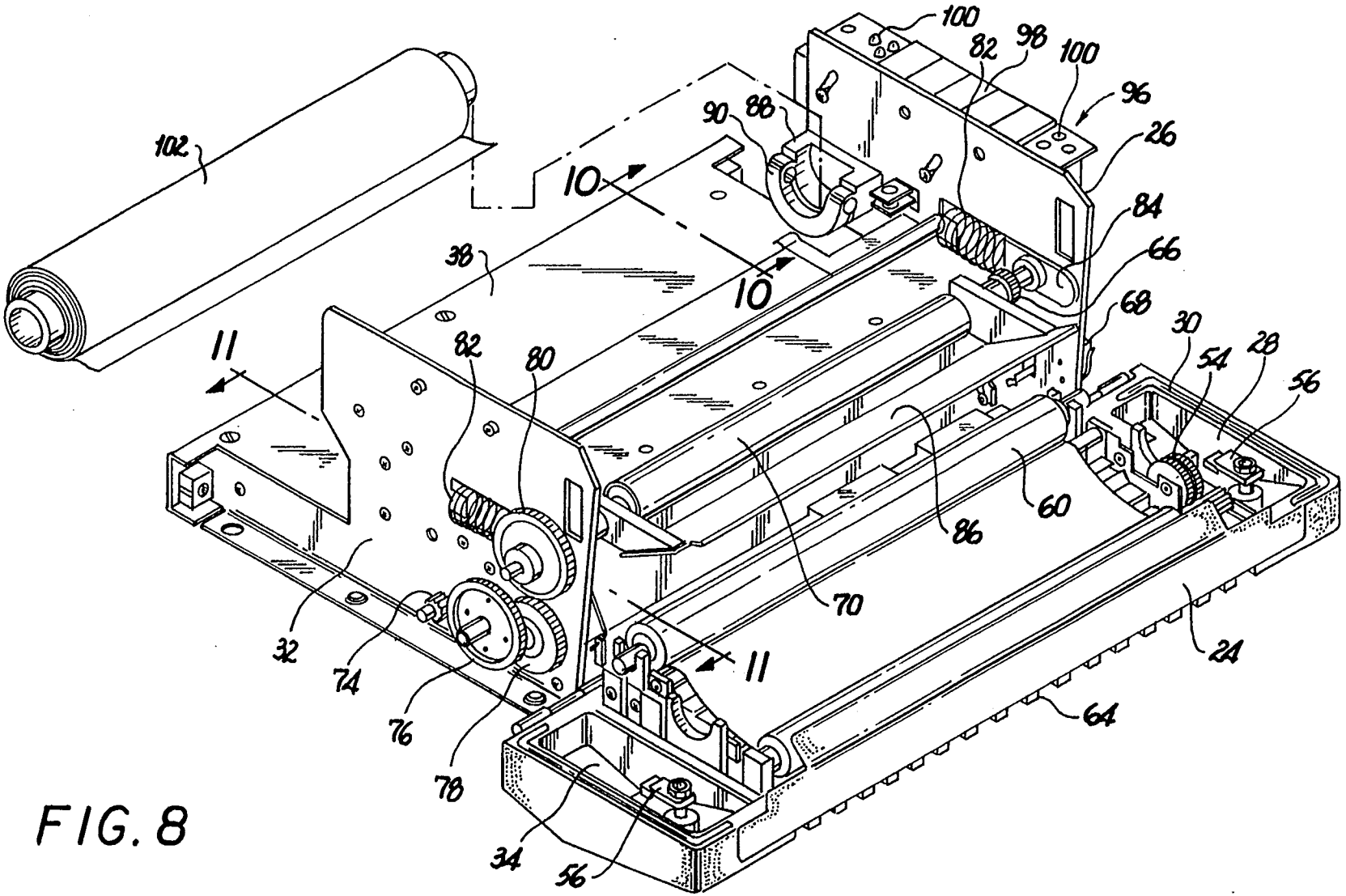
FIG. 8 is a perspective view of the interior frame of the thermal printer of FIG. 1 illustrating the roller components and associated drive mechanisms.

Referring to FIG. 8, upon closing of front door assembly 24, ink ribbon drive B gears 54 engage ink ribbon drive A gear 66 which provides the rotational movement of the ink ribbon. Door open switch 68 is provided to indicate to the processing system that front door assembly is either in the closed position or the open position. If the door is in the closed position the printer will be allowed to print, however, if the door is in the open position the printer will be inhibited from printing by the processing system and printing data will be stored by the processing system. Ink ribbon install switch 69 is electrically connected to the processing systems and is provided to detect whether an ink ribbon is present. If no ink ribbon is present, install switch 69 allows thermal printer to automatically operate as a direct thermal printer, i.e., by adjusting the print head pulse width. Similarly, detection of the presence of an ink ribbon allows thermal printer to automatically operate as a thermal transfer printer. When operating as a direct thermal printer, an ink ribbon sensing switch (not shown) is utilized to determine if the ink ribbon supply roller is at its end. Preferably, an optical switch is utilized to detect a marker at the end of the ink ribbon supply roller. The sensing switch is electrically connected to the processing system and if activated, the processing system responds by activating an indicator on the control panel 96.

Figure 7:
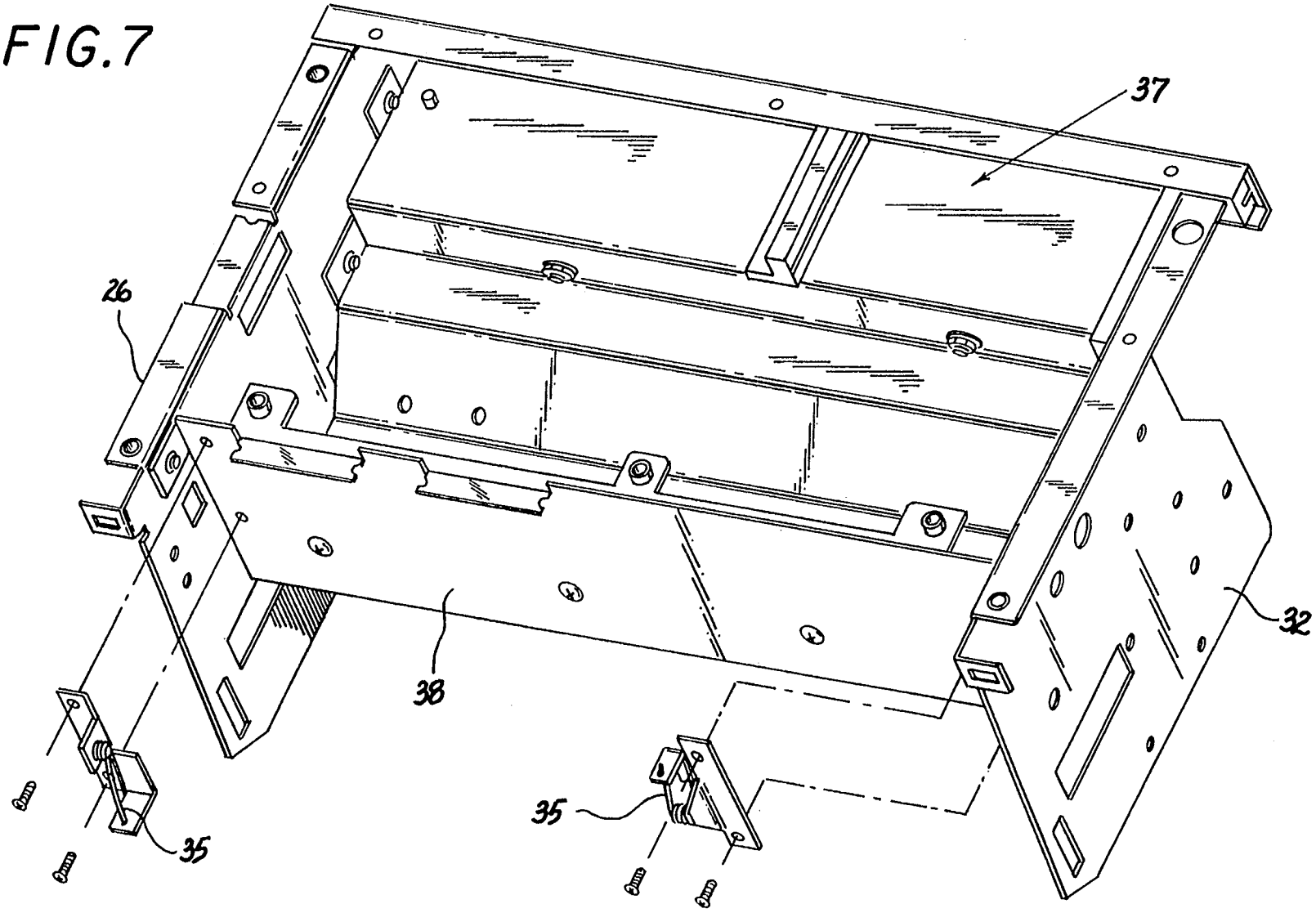
FIG. 7 is a perspective view of the underside of the frame of FIG. 2.
Figure 9:
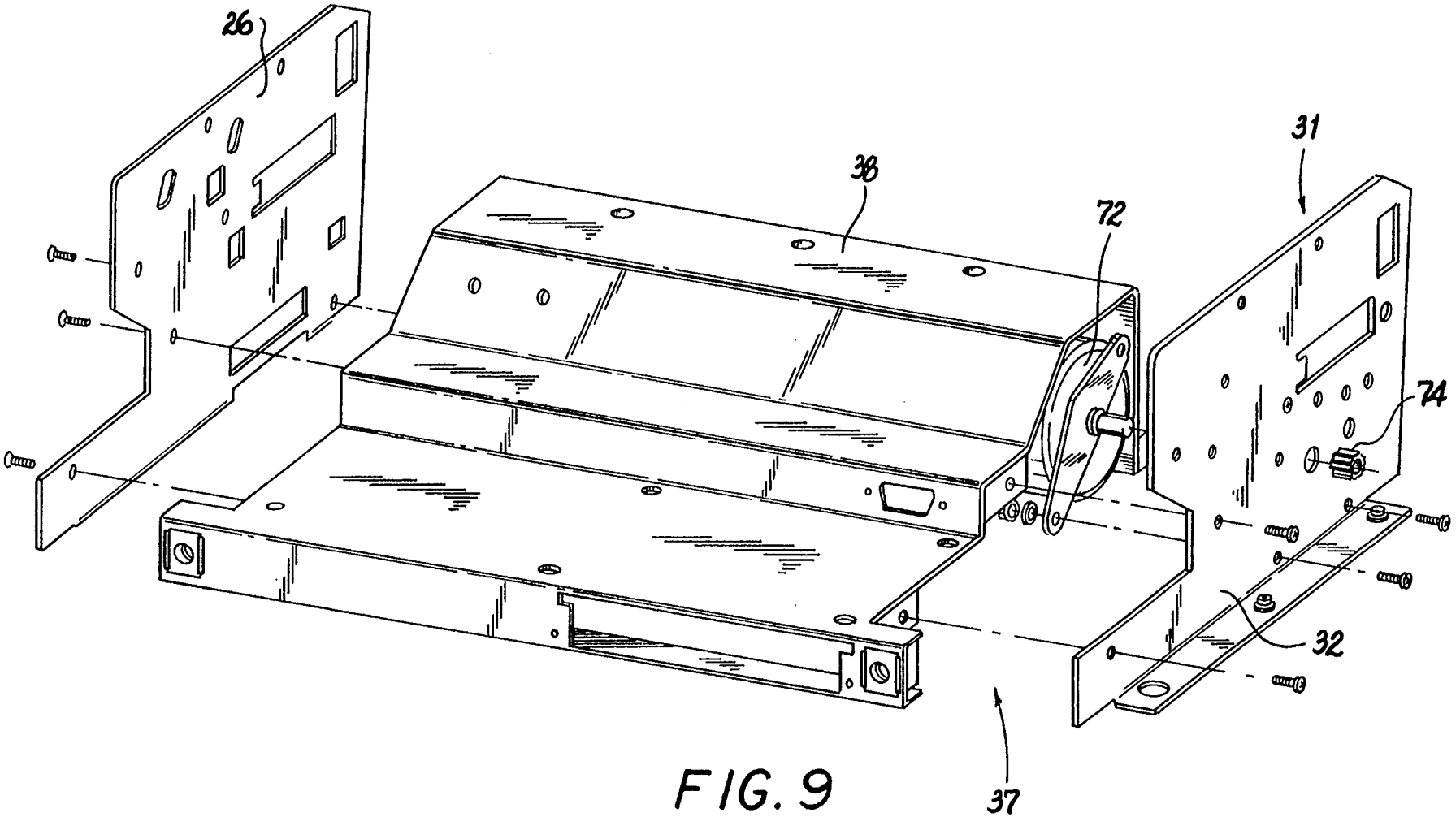
FIG. 9 is a perspective view with parts separated, the interior frame of FIG. 6 defining the lower electrically shield portion and the motor for driving the platen roller and ink ribbon roller.

Referring now to FIGS. 7, 8 and 9 the preferred paper and ink ribbon drive system includes motor 72 positioned within third electrically isolated portion 37 so that motor gear 74 extends from lower portion 37 through chassis wall 32 of chassis 31. Motor gear 74 engages platen drive A gear 76 which turns intermediate gear 78 and ultimately platen drive B gear 80. However, rotation from motor 72 to platen roller 70 may be obtained from numerous drive systems known in the art. For example, the drive system may be a belt drive connected between the motor and the platen roller. As noted above, the rotation of platen roller 70 is transferred to the ink ribbon via ink ribbon drive A gear 66 and ink ribbon drive B gear 54. Motor 72 is controlled by the processing system so as to properly feed the recording medium past heat generating section 40*a* at a predetermined rate and to properly rotate the ink ribbon at substantially the same rate as the recording medium. Preferably, the rotational rate of platen roller 70 is equivalent to 1/300 of an inch per step of motor 72.

The recording medium conveying system supplies the recording medium, e.g., standard paper or heat sensitive paper, to the location of the platen roller 70 and heat generation section 40*a* of thermal head 40. Once positioned adjacent to heat generating section 40*a*, information provided by the processing system may be recorded on the medium. Paper supply bushings 88, shown in FIGS. 2 and 8, retain a roll of the recording medium, e.g., standard paper or heat sensitive paper. Other paper supplies such as paper trays containing individual sheets of paper are also envisioned. Paper supply bushings 88 are configured to allow easy insertion and/or removal of the paper. As an example and referring to FIG. 2, bushings 88 may be configured as "U" shaped members configured to receive one end of the paper roll and allow for rotation thereof. In addition to providing easy loading or unloading of the paper, bushings 88 are also configured to rigidly secure the paper roll to prevent unwanted rotation of the paper roll during ,rugged use of the thermal printer.

Figure 10:
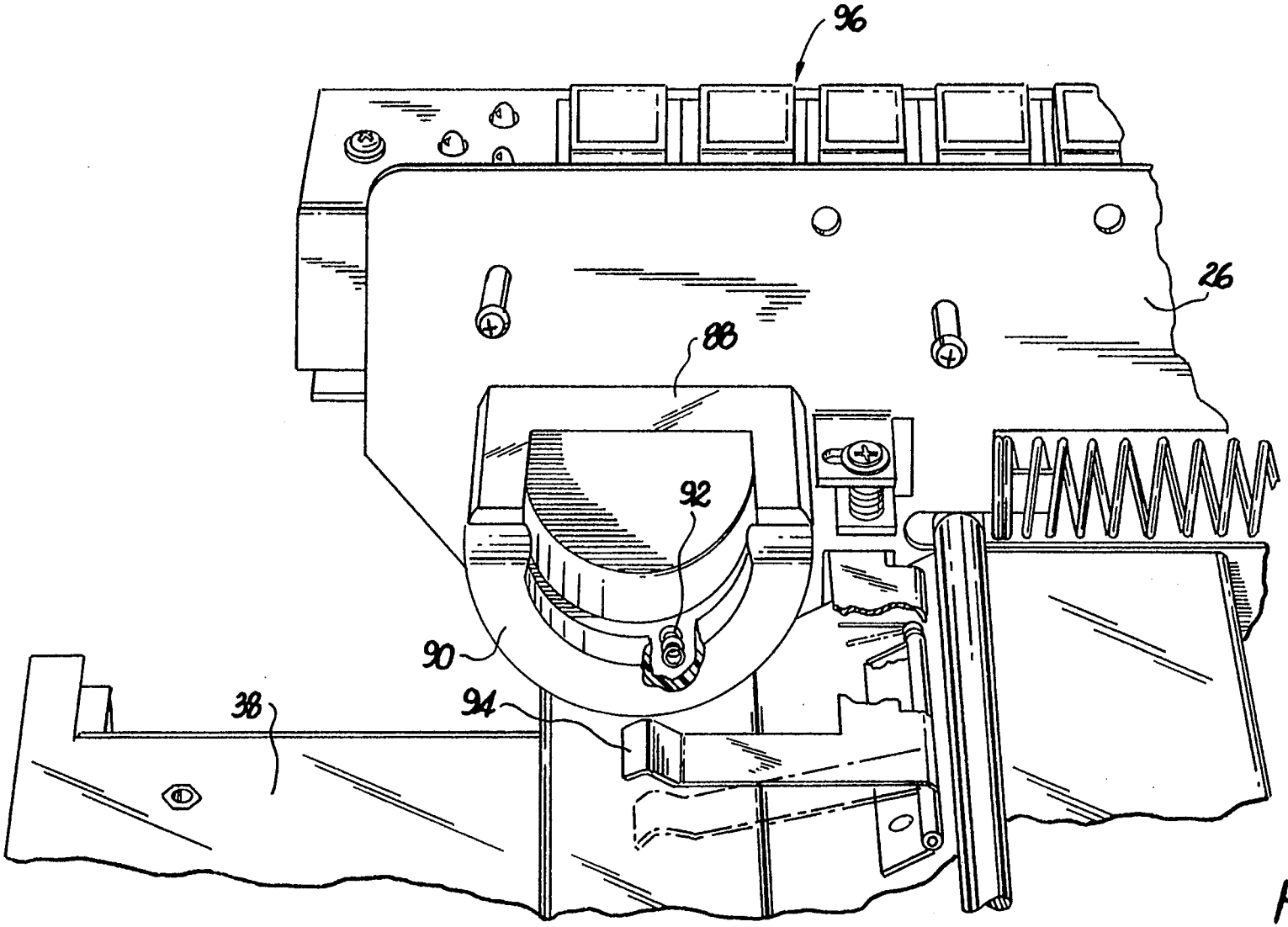
FIG. 10 is a sectional view of the interior frame taken along line 10—10 of FIG. 8 illustrating a portion of the recording medium conveying system.

As shown in FIG. 10, at least one of bushings 88 may have pressure arms 90 attached thereto, which apply pressure to the paper roll, thereby maintaining the roll in rigid securement to bushings 88 and assuring horizontal location of the paper while printing. Pressure arm spring 92 is positioned between bushing 88 and pressure arm 90 to bias pressure arm 90 toward the paper roll. Preferably, the pressure exerted by spring 92 is sufficient to rigidly retain the paper roll and prevent unintended rotation of the roll. Cover 14 has protrusions which lock the core of the paper roll in position so as to prevent mechanical shock and/or vibrations from interfering with the printing process.

Referring again to FIG. 10, recording medium detect switch 94 is electrically connected to the processing system to indicate whether there is sufficient amount of paper within the printer. Activation of switch 94 causes the processing system to inhibit printing and activates a warning indicator;on the control panel assembly 96.

Recording of information will now be described with reference to FIGS. 11 and 12. As noted above, thermal head 40 has heat generating section 40*a* embedded linearly therein, which is adapted to generate heat in response to the information signal supplied by the processing system. Thermal head 40 is positioned on the interior of front door assembly 24 such that when the door assembly is in the closed position, heat generating section 40*a* is at a location opposed to platen roller 70 along the longitudinal I axis of thermal head 40. Platen roller 70 is urged into opposition with heat generating section 40*a* by platen pressure compression springs 82 which are secured to left and right chassis sides 26 and 32 and to platen roller holding device 84. Platen roller holding device 84, under the compression force of springs 82, moves platen roller 70 towards thermal head 40. As noted above, if the thermal printer of the present invention is being operated as a transfer thermal printer, ink ribbon 60, shown in FIG. 12, would be positioned between heat generating section 40*a* and opposing platen roller 70 so as to transpose ink from ribbon 60 to the paper when heat generating section 40*a* is activated.

Figure 11:
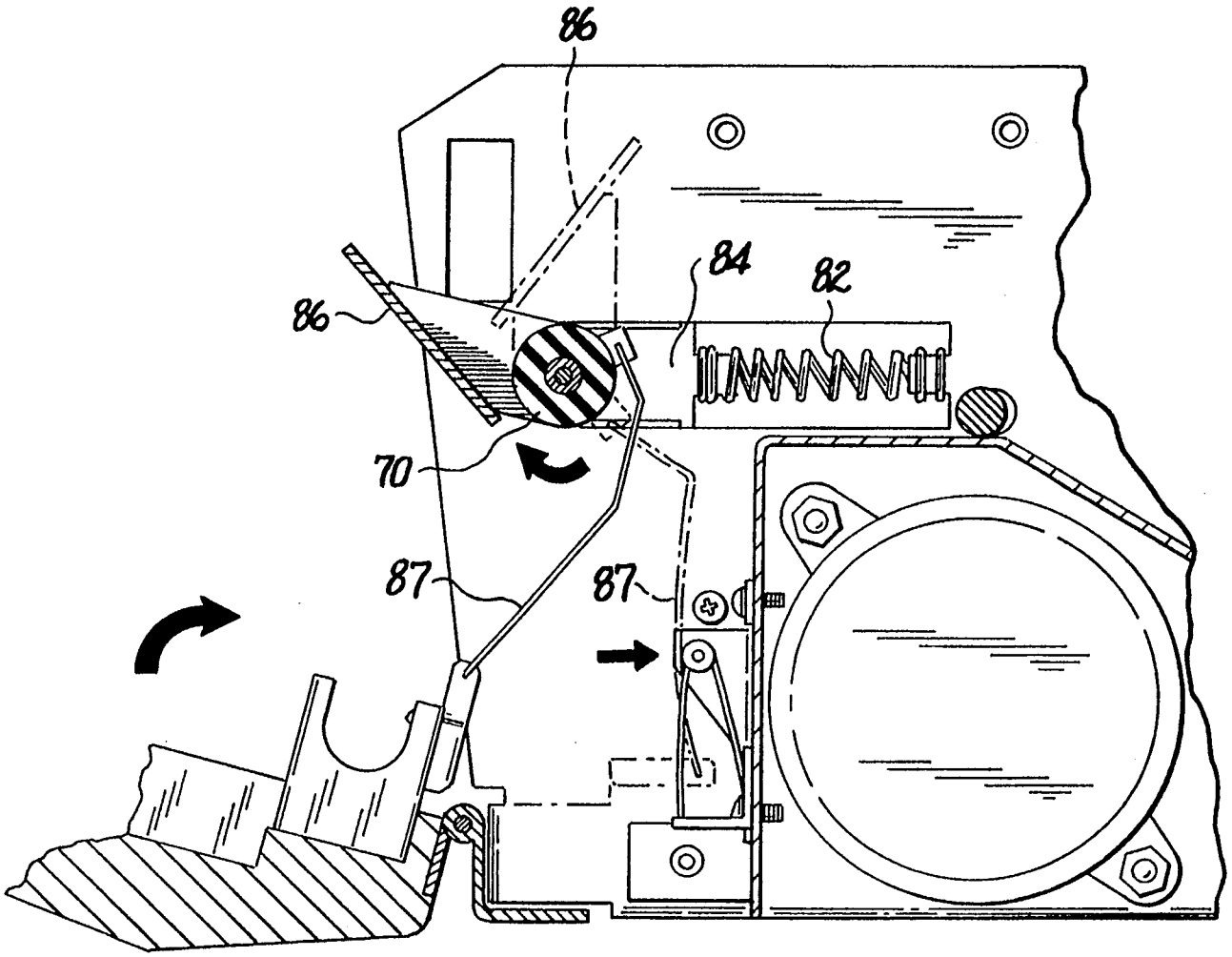
FIG. 11 is a sectional view of the interior frame taken along line 11—11 of FIG. 8 illustrating the articulating paper deflector.
Figure 12:
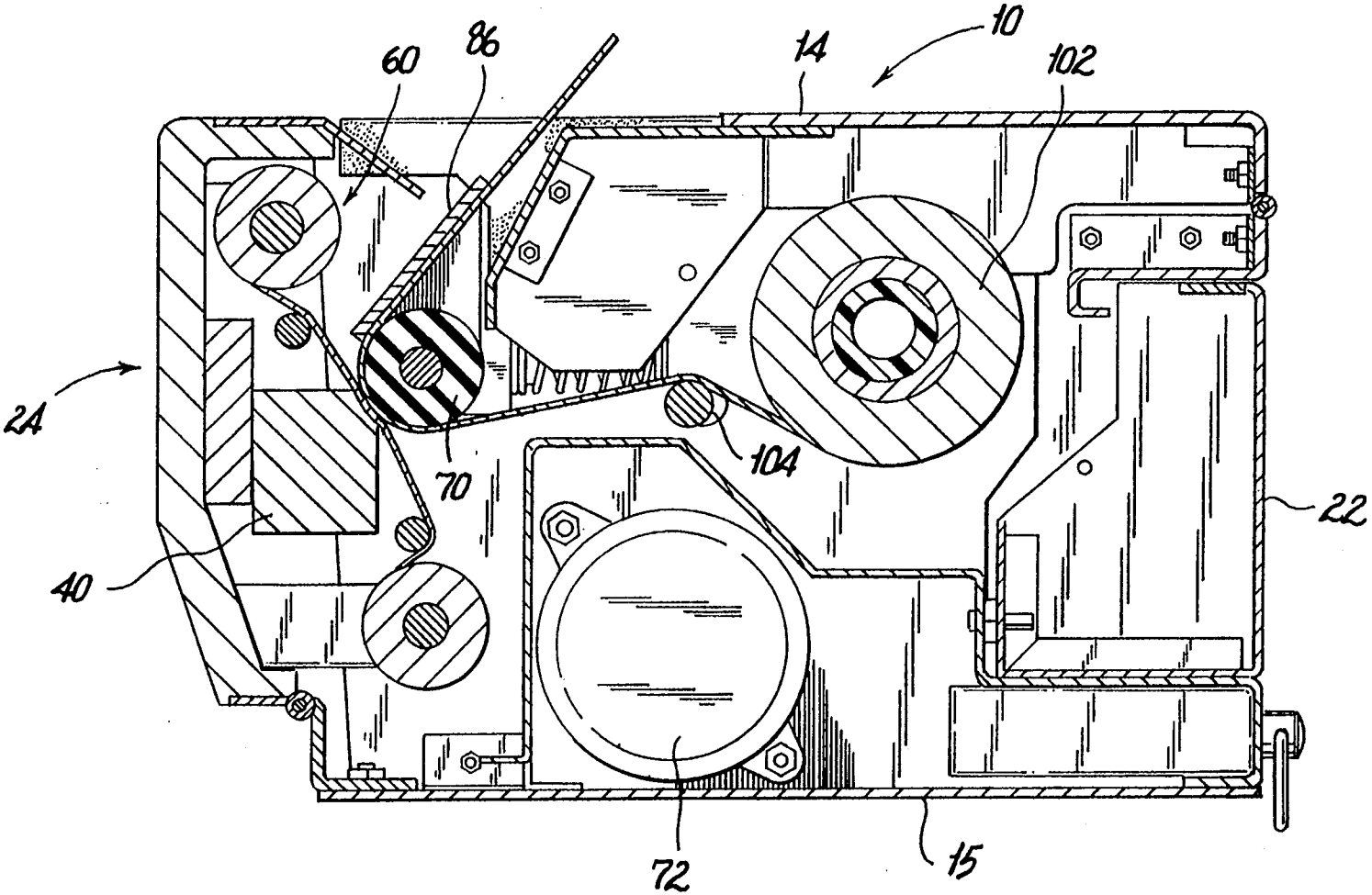
FIG. 12 is a cross-sectional view of the thermal printer taken along line 12—12 of FIG. 1.

With front door assembly 24 and cover 14 in the open position, shown in FIGS. 2 and 11, recording medium 102 is positioned-within the recording medium conveying system, as described above. Medium 102 is fed past medium guide 104 towards platen roller 70 and deflector 86 so that medium 102 is positioned between platen roller 70 and deflector 86. When front door assembly 24 is closed, deflector 86 automatically articulates in a clockwise direction which guides medium 102 out of the opening in cover 14, as shown in FIG. 12.

Referring again to FIGS. 2 and 8, the control and indicator assembly will now be described. Control panel assembly 96 is secured to right chassis panel 26 so that it is movable between a first position recessed from upper surface 16*b* of side surface 16 and a second position within opening 16*c* of upper surface 16*b*. In the preferred embodiment, control panel assembly 96 includes five control switches associated with certain functions which are electrically connected to the processing system. For example, one switch causes the paper to advance, while another switch will turn power to the printer "on" or "off". Control panel assembly 96 also includes indicators which provide an operator with information as to the status of certain internal components.

Generally, the indicators are of the LED type, which illuminate when predetermined electrical conditions are satisfied. However, other types of indicators may be utilized, such as audio indicators, LCD displays, and the like. As an example, the indicators may indicate whether the battery is charged or low, or whether power in the printer is "on".

Referring again to FIG. 3, the rear module assembly will be described. Rear module 22 is releasably secured to the printer and provides DC power to the printer which is derived from either an AC or a DC source. In one embodiment, rear drawer 22 is provided with a battery (not shown) which provides sufficient power to operate the motor, and the processing system. In another embodiment, rear drawer 22 is provided with a receptacle to connect to an external AC supply and convert the AC power to DC for operating the above described internal components.

To ensure proper high speed operation of the thermal printer, housing 12 is divided into electrically shielded sections or compartments. As shown in FIG. 2, these compartments inhibit electrical and/or magnetic interference or noise radiating to the environment and emanating from the thermal printer from interfering with the printing operation and/or the transmission or storing of data within the thermal printer. The first electrically isolated section is defined by right chassis panel 26, first side surface 16, a segment of lower surface 15, interior right side 28 of front door assembly 24 and rear drawer 22. Interior right side 28 of front door assembly 24 is provided with EMI (Electro Magnetic Interference) gasket 30 which ensures that the front surface 16*a* of first side surface 16 is in electrical contact with the mating surface of interior right side 28 so as to effectively shield the interior of housing 12 from outside electrical and/or magnetic interference.

The second electrically isolated section is defined by left chassis panel 32, second side surface 18, a segment of lower surface 15, interior left side 34 of front door assembly 24 and rear drawer 22. Interior left side 34 is also provided with EMI gasket 30, which ensures that the front surface 18*a* of second side surface 18 is in electrical contact with the mating surface of interior left side 34 so as to effectively shield the interior of housing 12 from outside electrical and/or magnetic interference.

Referring additionally to FIG. 7, the third electrically isolated section is defined by right and left chassis panels 26 and 32, isolation bracket 38 which extends from the front to the rear of housing 12 and lower surface 15. The third electrically isolated section electrically shields the processing system (not shown) from the outside environment and from the remainder of the inside environment of the thermal printer 10. When thermal printer 10 is operating at high speed, e.g., at least about 600 lines per minute, electrical and/or magnetic isolation of the printer increases the integrity of the data being printed by reducing the possibility of electrical and/or magnetic interference from distorting the electrical signal indicative of the text being printed.

It will be understood that various modifications can be made to the embodiments of the present invention herein disclosed without departing from the spirit and scope thereof. For example, various sizes of the instrument are contemplated, as well as various types of construction materials. Also, various modifications may be made in the configuration of the parts. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. A thermal printer, which comprises:

(a) a housing having an interior frame constructed to isolate at least an interior portion of said thermal printer with respect to electromagnetic interference;

(b) a door having an exterior surface and an interior surface wherein at least a portion of said interior surface is selectively engagable with said housing so as to provide access to said frame, said portion of said interior surface of said door having an interference isolation member secured thereto which engages said housing when said interior surface of said door engages said housing;

(c) a thermal head mounted on said interior surface of said door to facilitate recording of information on a recording medium;

(d) platen roller means positioned within said frame for conveying said recording medium between said platen roller means and said thermal head; and (e) rotation means operatively connected to said platen roller means for rotating said platen roller means at a predetermined rate.

2. The thermal printer according to claim 1, further comprising processing means positioned within said frame for interfacing the thermal printer with a controlling device, for storing information and for facilitating high speed printing of said information.

3. The thermal printer according to claim 2, further comprising recording medium support means positioned within said frame for rigidly supporting said recording medium within said frame.

4. The thermal printer according to claim 2, wherein said processing means comprises:

(a) processor means having a stored program for controlling the printing of the thermal printer and interfacing the thermal printer with said controlling device; and (b) serial interface means for sequentially sending print data to said thermal head.

5. The thermal printer according to claim 4, wherein said serial interface means comprises gate array means for receiving character data and bit count data, deriving said print data, and sending said print data to said thermal head in a first in first out sequence to permit the thermal printer to print at predetermined rates.

6. The thermal printer according to claim 5, wherein said high speed printing of said information is at a rate of at least about 600 lines per minute.

7. The thermal printer according to claim 3, wherein said recording medium support means comprises:

(a) a first bushing positioned within said frame for receiving one end of a recording medium roll; and (b) a second bushing for receiving a second end of the recording medium roller, said second bushing positioned within said frame in opposition to said first bushing such that said recording medium is substantially parallel to a horizontal axis of said frame, said second bushing having a pressure arm secured thereto which exerts pressure on said recording medium thereby maintaining said recording medium in said frame.

8. The thermal printer according to claim 3, further comprising door switch means secured to said frame and electrically connected to said processing means for interfering with the printing operation of the thermal printer when said door is in said open position.

9. The thermal printer according to claim 3, further comprising recording medium switch means secured to said frame and electrically connected to said processing means for interfering with the printing operation of the thermal printer when the amount of recording medium present falls below a predetermined level.

10. The thermal printer according to claim 3, further comprising control panel means for controlling the operation of predetermined functions of the thermal printer and indicating the status of predetermined functions of the thermal printer.

11. The thermal printer according to claim 10, wherein said control panel means is slidably secured to said frame and electrically connected to said processing means.

12. The thermal printer according to claim 10, wherein said control panel means comprises at least one function control switch and at least one function status indicator.

13. The thermal printer according to claim 3, further comprising a drawer removably secured to said housing and removable power supply means disposed within said drawer for providing power to the thermal printer.

14. The thermal printer according to claim 13, wherein said power supply means comprises a DC battery disposed in said drawer.

15. The thermal printer according to claim 13, wherein said power supply means comprises an AC connection coupled to AC/DC conversion means, said connection and conversion means disposed in said drawer.

16. The thermal printer according to claim 1, wherein said frame comprises interference isolation means for isolating the thermal printer from emitting or receiving ambient electrical or magnetic conditions.

17. The thermal printer according to claim 16, wherein said interference isolation means, comprises:

(a) an interior portion;

(b) a lower portion positioned beneath said interior portion;

(c) right and left side portions positioned adjacent said interior portion and said lower portion; and (d) a rear portion positioned adjacent said interior portion at a rear of said frame.

18. The thermal printer according to claim 1, wherein said door further comprises:

(a) ink ribbon support means for positioning at least a portion of an ink ribbon adjacent said thermal head such that heat generated by said thermal head transfers ink from said ink ribbon to said recording medium; and (b) ink ribbon transmission means secured to said door for conveying said ink ribbon past said thermal head at a predetermined rate of speed.

19. The thermal printer according to claim 18, further comprising ink ribbon switch means secured to said frame and electrically connected to said processing means for interfering with the printing operation of the thermal printer when said ink ribbon support means is without said ink ribbon.

20. The thermal printer according to claim 1, wherein said platen roller means comprises:

(a) a platen roller positioned within said frame such that said platen roller is opposed to said thermal head when said door is in a closed position;

(b) deflector means for guiding said recording medium out of a top of said frame, said deflector means being articulated between a first position when said door is in an open position and a second position when said door is in said closed position; and (c) platen pressure means positioned within said frame for pressing said platen roller into opposition with said thermal head.

21. A thermal printer which comprises:

(a) a housing having an interior frame constructed to isolate at least an interior portion of said thermal printer with respect to electromagnetic interference;

(b) a door having an exterior surface and an interior surface wherein at least a portion of said interior surface is selectively engagable with said housing so as to provide access to said frame, said portion of said interior surface of said door having an interference isolation member secured thereto which engages said housing when said interior surface of said door engages said housing;

(c) a thermal head mounted on said interior surface of said door to facilitate recording of information on a recording medium;

(d) platen roller means positioned within said frame for conveying said recording medium between said platen roller means and said thermal heat;

(e) processing means positioned within said frame for interfacing the thermal printer with a controlling device, for storing information and for facilitating high speed printing of said information at a rate of at least about 600 lines per minute; and (f) recording medium support means positioned within said frame for rigidly supporting said recording medium within said frame.

22. The thermal printer according to claim 21, wherein said processing means comprises:

(a) processor means having a stored program for controlling the printing of the thermal printer and interfacing the thermal printer with said controlling device; and (b) serial interface means for sequentially sending print data to said thermal head means.

23. The thermal printer according to claim 22, wherein said serial interface means comprises:

(a) FIFO means for receiving character data and bit count data and sending said character and bit count data in a first in first out sequence; and (b) gate array means connected to said FIFO means for receiving said character and bit count data, deriving said print data, and sending said print data to said thermal head in a first in first out sequence to permit the thermal printer to print at predetermined rates.

24. The thermal printer according to claim 21, further comprising rotation means operatively connected to said platen roller means for rotating said platen roller at a predetermined rate.

25. The thermal printer according to claim 21, wherein said frame comprises interference isolation means for isolating the thermal printer from ambient electrical or magnetic conditions.

26. The thermal printer according to claim 25, wherein said interference isolation means, comprises:

(a) an interior portion;

(b) a lower portion positioned beneath said interior portion;

(c) right and left side portions positioned adjacent said interior portion and said lower portion; and (d) a rear portion positioned adjacent said interior portion at a rear of said frame.

27. The thermal printer according to claim 26, further comprising a rear module removably secured to said housing and power supply means secured within said rear module for providing power to the thermal printer, said rear module [means]configured to engage said rear portion of said frame.

28. The thermal printer according to claim 27, wherein said power supply means comprises a DC battery disposed in said rear module.

29. The thermal printer according to claim 27, wherein said power supply comprises an AC connection coupled to AC/DC conversion means, said connection and conversion means disposed in said rear module.

30. The thermal printer according to claim 21, wherein said door further comprises:

(a) ink ribbon support means for positioning at least a portion of an ink ribbon adjacent said thermal head such that heat generated by said thermal head transfers ink from said ink ribbon to said recording medium; and (b) ink ribbon transmission means secured to said door for conveying said ink ribbon past said thermal head at a predetermined rate of speed.

31. The thermal printer according to claim 30, further comprising ink ribbon switch means secured to said frame and electrically connected to said processing means for interfering with the printing operation of the thermal printer when said ink ribbon support means is without said ink ribbon.

32. The thermal printer according to claim 21, wherein said platen roller means, comprises:

(a) a platen roller positioned within said frame such that said platen roller is opposed to said thermal head when said door is in a closed position;

(b) deflector means for guiding said recording medium out of a top of said frame, said deflector means being automatically articulated between a first position when said door is in an open position and a second position when said door is in said closed position; and (c) platen pressure means positioned within said frame for pressing said platen roller into opposition with said thermal head.

33. The thermal printer according to claim 21, wherein said recording medium support means comprises:

(a) a first bushing positioned within said frame for receiving one end of a recording medium roll; and (b) a second bushing for receiving a second end of the recording medium roller, said second bushing positioned within said frame in opposition to said first bushing such that said recording medium is parallel to a horizontal axis of said frame, said second bushing having a pressure arm secured thereto which exerts pressure on said recording medium thereby maintaining said recording medium in said frame.

34. The thermal printer according to claim 33 further comprising cover means pivotally secured to said housing for further securing said recording medium in said first and second bushings.

35. The thermal printer according to claim 21, further comprising door switch means secured to said frame and electrically connected to said processing means for interfering with the printing operation of the thermal printer when said door is in said open position.

36. The thermal printer according to claim 21, further comprising recording medium switch means secured to said frame and electrically connected to said processing means for interfering with the printing operation of the thermal printer when the amount of recording medium present falls below a predetermined level.

37. The thermal printer according to claim 21, further comprising control panel means for controlling the operation of predetermined functions of the thermal printer and indicating the status of predetermined functions of the thermal printer.

38. The thermal printer according to claim 37, wherein said control panel means is slidably secured to said frame and electrically connected to said processing means.

39. The thermal printer according to claim 37, wherein said control panel means comprises at least one function control switch and at least one function status indicator.

40. A direct thermal printer which comprises:

(a) a housing;

(b) a frame disposed in said housing, said frame having interference isolating portions for isolating the thermal printer with respect to electrical or magnetic conditions, said interference isolating portions including:

(i) a front door assembly pivotally connected to a front portion of said frame;

(ii) an interior portion positioned adjacent to said front door assembly, said interior portion being defined by first and second side members and an isolation member of said frame, and a portion of said housing;

(iii) a lower portion positioned beneath said interior portion and defined by said first and second side members and said isolation member of said frame;

(iv) first and second side portions positioned adjacent said interior portion and said lower portions, said first side portion being associated with said first side member and defined by said first side member and said housing, said second side portion being associated with said second side member and defined by said second side member and said housing; and (v) a rear drawer positioned adjacent said interior portion at a rear portion of said frame;

(c) a platen roller positioned within said interior portion of said frame and having a shaft for rotatably securing said platen roller to said left and right side portions;

(d) a thermal head longitudinally positioned on an inner surface of said front door assembly;

(e) ink ribbon support means positioned within an inner surface of said front door assembly for supporting an ink ribbon;

(t) paper rotation transmission means disposed on one side of said shaft of said platen roller for transmitting rotation to said platen roller;

(g) ink ribbon rotation transmission means disposed on one side of said shaft of said platen roller and within said inner surface of said front door assembly for transmitting rotation to said ink ribbon;

(h) platen pressure means positioned on said left and right side portions for pressing said platen roller into opposition with said thermal head;

(i) processing means positioned within said lower portion of said frame for interfacing the thermal printer with a controlling device, for storing information to be printed and for facilitating high speed printing of the information; and (j) paper support means positioned within said interior portion for rigidly supporting a paper roll within said frame.

41. The thermal printer according to claim 40, further comprising, a paper roll releasably engaged with said paper support means.

42. The thermal printer according to claim 41, further comprising an ink ribbon releasably engaged with said ink ribbon support means and being at least partially in engagement with said ink ribbon rotation transmission means.

* * * * *